US008944785B2

(12) United States Patent
Lilie et al.

(10) Patent No.: US 8,944,785 B2
(45) Date of Patent: Feb. 3, 2015

(54) PISTON AND CYLINDER COMBINATION DRIVEN BY LINEAR MOTOR WITH CYLINDER POSITION RECOGNITION SYSTEM AND LINEAR MOTOR COMPRESSOR, AND AN INDUCTIVE SENSOR

(75) Inventors: Dietmar Erich Bernhard Lilie, Joinville (BR); Paulo Sergio Dainez, Joinville (BR); Nerian Fernando Ferreira, Joinville (BR); Marcelo Knies, Joinville (BR)

(73) Assignee: Whirlpool S.A., Sao Paulo (BR)

( * ) Notice: Subject to any disclaimer, the term of this patent is extended or adjusted under 35 U.S.C. 154(b) by 886 days.

(21) Appl. No.: 12/810,953

(22) PCT Filed: Dec. 29, 2008

(86) PCT No.: PCT/BR2008/000401

§ 371 (c)(1),
(2), (4) Date: Sep. 23, 2010

(87) PCT Pub. No.: WO2009/082800

PCT Pub. Date: Jul. 9, 2009

(65) Prior Publication Data

US 2011/0008191 A1 Jan. 13, 2011

(30) Foreign Application Priority Data

Dec. 28, 2007 (BR) ..... 0704947

(51) Int. Cl.
*F04B 17/04* (2006.01)
*F04B 35/04* (2006.01)

(52) U.S. Cl.
CPC ..... *F04B 35/045* (2013.01); *F04B 2201/0201* (2013.01); *F04B 2203/0402* (2013.01)
USPC ..... 417/417; 417/63

(58) Field of Classification Search
CPC ..... F04B 17/04; F04B 17/042; F04B 17/044; F04B 35/045; F04B 2201/0201; F04B 2201/0206; F04B 2203/0401; F04B 2203/0402; F04B 2203/0403
USPC ..... 417/44.1, 63, 417
See application file for complete search history.

(56) References Cited

U.S. PATENT DOCUMENTS 4,086,518 A * 4/1978 Wilkinson ..... 318/127
5,342,176 A 8/1994 Redlich (Continued)

FOREIGN PATENT DOCUMENTS

DE 103 14 007 10/2004
DE 10 2006 009 231 8/2007

(Continued)

OTHER PUBLICATIONS

International Search Report mailed Apr. 20, 2009 for International application No. PCT/BR2008/000401.

(Continued)

*Primary Examiner* — Peter J Bertheaud
(74) *Attorney, Agent, or Firm* — Fay Sharpe LLP

(57) ABSTRACT

A piston and cylinder combination driven by linear motor with cylinder position recognition system, including a support structure forming an air gap; a motor winding generating a variable magnetic flow along part of the air gap; a cylinder having a head at one end; a piston connected to a magnet, the magnet driven by the magnetic flow of the motor winding to move inside a displacement path including at least partially the air gap; the displacement of the magnet making the piston reciprocatingly move inside the cylinder; and an inductive sensor disposed at a point of the displacement path of the magnet, such that when the piston reaches a position of closest approach to the cylinder head, the inductive sensor detects a variation in the magnetic field resulting from the corresponding position of the magnet, and generates a voltage signal arising from this magnetic field variation.

18 Claims, 5 Drawing Sheets

(56) References Cited

U.S. PATENT DOCUMENTS

| | | | | |
|---|---|---|---|---|
| 6,084,320 | A * | 7/2000 | Morita et al. | 310/12.33 |
| 7,472,639 | B2 * | 1/2009 | Park | 92/5 R |
| 7,868,566 | B2 * | 1/2011 | Bechtold et al. | 318/135 |
| 8,057,190 | B2 * | 11/2011 | Reinschke | 417/44.1 |
| 2002/0064463 | A1 | 5/2002 | Park et al. | |
| 2003/0161734 | A1 | 8/2003 | Kim | |
| 2005/0168179 | A1 | 8/2005 | McGill et al. | |

FOREIGN PATENT DOCUMENTS

| | | |
|---|---|---|
| EP | 1 524 434 | 4/2005 |
| JP | 11-33661 | 12/1999 |
| WO | WO 00/63555 | 10/2000 |
| WO | WO 2001/071186 | 9/2001 |
| WO | WO 2004/025120 | 3/2004 |
| WO | WO 2007/049876 | 5/2007 |
| WO | WO 2007/123323 | 11/2007 |

OTHER PUBLICATIONS

Written Opinion of the International Searching Authority mailed Apr. 20, 2009 for International application No. PCT/BR2008/000401.
Response to Written Opinion mailed Oct. 28, 2009 for International application No. PCT/BR2008/000401.
International Preliminary Report on Patentability completed Mar. 5, 2010 for International application No. PCT/BR2008/000401.

* cited by examiner

*Fig.2A*
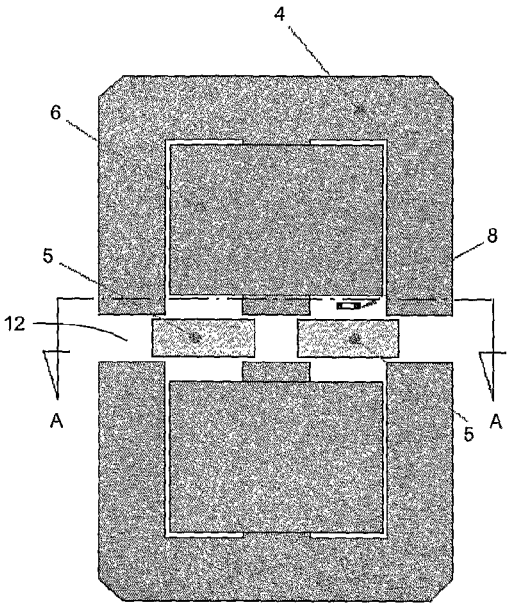
*Fig.3A*
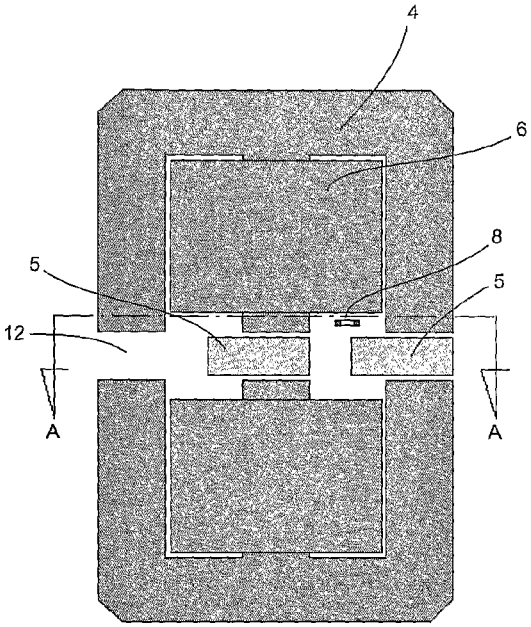
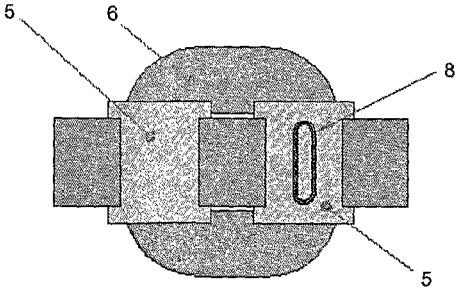
*Fig.2B*
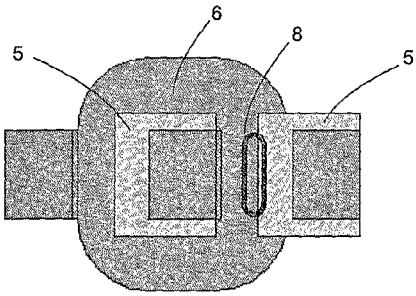
*Fig.3B*

PISTON AND CYLINDER COMBINATION DRIVEN BY LINEAR MOTOR WITH CYLINDER POSITION RECOGNITION SYSTEM AND LINEAR MOTOR COMPRESSOR, AND AN INDUCTIVE SENSOR

This application claims priority of Brazilian patent case No. PI0704947-1 filed on Dec. 28, 2007, the disclosure thereof being herby incorporated by reference.

The present invention discloses a piston and cylinder combination driven by linear motor, with cylinder position recognition system, which is capable of detecting the amplitude of piston operation and maximize the piston compression capacity. The invention also discloses a linear motor compressor to which a piston and cylinder combination of this kind is applied, as well as an inductive sensor applicable to the compressor that is the object of the present invention.

DESCRIPTION OF THE PRIOR ART

Currently, the use of piston and cylinder combinations driven by linear motors is very common. This type of piston and cylinder combination is advantageously applied, for example, to linear compressors, in refrigeration systems, such as refrigerators and air-conditioning appliances. The linear compressors present low energy consumption and, therefore, are highly efficient for the application in question.

The linear compressor normally comprises a piston which moves inside a cylinder. The head of this cylinder houses suction valves and gas discharge valves, which regulate the entry of low pressure gas and the exit of high pressure gas from inside the cylinder. The axial motion of the piston inside the cylinder of the linear compressor compresses the gas admitted by the suction valve, increasing the pressure thereof, and discharging it though the discharge valve to a high pressure zone.

The linear compressor must be able to identify the position and controlling the displacement of the piston inside the cylinder to prevent the piston from colliding with the cylinder head, or with other components arranged at the other end of the piston path, which causes a loud and unpleasant noise, in addition to wear and tear of the equipment.

Nevertheless, to optimize the efficiency and the performance of the linear compressor and minimize the compressor's consumption of energy, it is desirable that the piston is displaced as much as possible inside the cylinder, approaching as close as possible to the piston head without colliding with it. For this to be possible, the displacement amplitude of the cylinder when the compressor is in operation must be known precisely, whereas the larger the estimated error of this amplitude is considered, the greater will be the safety distance between the maximum point of the piston's path and the cylinder head, to avoid collision thereof. This safety distance provides a loss in efficiency of the compressor.

Certain mechanisms and systems that control the axial displacement of the piston inside the cylinder of a compressor are already known within the prior art. These include the patent case U.S. Pat. No. 5,342,176, which proposes a method to foresees the amplitude of piston operation by monitoring the motor variables, such as current and voltage applied to the permanent magnet linear motor. In other words, the linear motor itself is the piston position transducer. This solution presents the advantage of dispensing with the use of an additional transducer, such as a sensor, inside the compressor. However, the proposed method has the major drawback of having very low precision, which causes a considerable performance loss for the compressor, because it requires a large safety distance between the piston and the cylinder head in order to avoid collision.

Patent case JP 11336661 describes a piston position control unit, which uses discrete position signals measured by a position sensor and subsequently interpolates them to determine the maximum advance position of the piston. With this solution, it is possible to reach a high degree of accuracy of the displacement amplitude of the piston. However, the measuring of the displacement amplitude of the piston is not performed at a convenient position where one measures the distance between the piston and the cylinder head. For this reason the system of this invention is subject to tolerances in the assembly position of the position sensor.

Patent application BR 0001404-4 describes a position sensor particularly appropriate for detecting the position of an axially displaceable compressor. The compressor comprises a valve blade that is placed between the head and a hollow body where the piston moves. The sensor comprises a probe electrically connected to a control circuit, the probe being capable of capturing the passage of the piston by a point of the hollow body and to signal for the control circuit. This system is, therefore, capable of measuring the distance between the piston and the cylinder head, but the architecture of the electrical circuit used as cylinder position transducer generates undesirable electrical noise, due to the electrical contact failures, which generates inaccurate readings.

Patent application BR 0203724-6 proposes another form of detecting the piston position in a linear compressor, to prevent it from colliding with the fluid transfer board when variations occur in the compressor operating conditions, or even in the power voltage. The proposed solution in this patent case measures the distance between the piston and the fluid board directly on the top of the piston, and is therefore a highly accurate solution. However, this architecture requires space for installing the sensor on the valve board besides been more costly.

None of the documents of the prior art is, therefore, capable of combine a good precision of control and determination of the piston position with low cost in a piston displacement measurement system that measures the distance directly between the piston and the cylinder head where the valve board is located.

OBJECTIVES OF THE INVENTION

A first objective of the invention is to provide a means of measuring the displacement amplitude of the piston inside the cylinder that provides a signal free of electrical noise and has high precision and definition.

Another objective of the invention is to provide a piston and cylinder combination capable of detecting the displacement amplitude of the piston inside the cylinder that dispenses the use of electronic circuits to deal with the signal of a position sensor, by means of a simple and low-cost equipment.

It is also an objective of the invention to prevent the impact of the piston with the cylinder head and with the valve board, as well as with any other element that may be disposed at the other end of the piston path.

BRIEF DESCRIPTION OF THE INVENTION

The objectives of the invention are achieved by means of a piston and cylinder combination driven by linear motor with cylinder position recognition system, comprising a support structure forming an air gap; a motor winding generating a variable magnetic flow at least along a part of the air gap; a cylinder comprising a head at one of its ends; a piston connected to a magnet, the magnet being driven by the magnetic flow of the motor winding to move on a displacement path including at least partially the air gap; the displacement of the magnet making the piston reciprocatingly move inside the cylinder; and an inductive sensor disposed at a point of the displacement path of the magnet, such that, when the piston reaches at least a pre-selected position, the inductive sensor detects a variation in the magnetic field resulting from the corresponding position of the magnet, and generates a voltage signal arising from this magnetic field variation.

A pre-selected position that the piston reaches is preferably a position of the displacement path at its closest approach to the cylinder head. Another pre-selected position that the piston reaches is a position of the displacement path farthermost from the cylinder head.

The inductive sensor comprises preferably a sensor coil disposed along the displacement direction of the magnet, and the sensor coil is elongated transversally to the displacement direction of the magnet, and narrow along the displacement direction of the magnet.

The inductive sensor is preferably disposed at a point of the displacement path of the magnet coinciding with the position of the magnet, when the piston reaches a position of closest approach to the cylinder head. Even more preferably, when the piston reaches a position of closest approach to the cylinder head, the position of the lower end of the magnet coincides with the position of the sensor, and the variation of the magnetic field applied by the magnet on the inductive sensor produces a voltage difference between the terminals of the inductive sensor.

Alternatively, the inductive sensor may be disposed at a point of the displacement path of the magnet coinciding with the position of the magnet, when the piston reaches a position farthermost from the head. When the piston reaches a position farthermost from the cylinder head, the position of the upper end of the magnet coincides with the position of the sensor, and the variation of the magnetic field applied by the magnet on the inductive sensor produces a voltage difference between the terminals of the inductive sensor.

The inductive sensor may be disposed inside the air gap or outside the air gap. The cylinder head may have a suction valve and a discharge valve which communicate with the inside part of the cylinder.

The objectives of the invention are also achieved by means of a linear motor compressor comprising a support structure forming an air gap; a motor winding generating a variable magnetic flow at least along part of the air gap; a cylinder having a valve board at its upper end, which admits low pressure air into the cylinder, from a low pressure air chamber, and discharges high pressure air out of the cylinder; a piston connected to a magnet, the magnet being driven by the magnetic flow of the motor winding to move inside a displacement path including at least partially the air gap; the displacement of the magnet making the piston reciprocatingly move inside the cylinder; an inductive sensor disposed at a point of the displacement path of the magnet, such that when the piston attains at least a pre-selected position of the valve board, the inductive sensor detects a variation in the magnetic field resulting from the corresponding position of the magnet, and generates a voltage signal arising from this magnetic field variation.

In the compressor according to the invention, a pre-selected position that the piston attains is preferably a position of the displacement path at its closest approach to the cylinder head. Another pre-selected position that the piston attains is a position of the displacement path farthermost from the cylinder head.

The compressor according to the invention preferably comprises a piston and cylinder combination driven by linear motor with cylinder position recognition system of the kind described previously.

Further, the objectives of the present invention are translated by an inductive sensor applicable to a linear motor compressor, the inductive sensor comprising a sensor coil disposed along the displacement direction of the magnet, the sensor coil being substantially elongated transversally to the displacement direction of the magnet, and substantially narrow in the displacement direction of the magnet.

BRIEF DESCRIPTION OF THE DRAWINGS

The present invention will now be described in greater detail based on an example of embodiment represented in the drawings. The figures show:

FIG. 2A—is a schematic, cross-sectional view of the piston and cylinder combination with the cylinder position recognition system of the present invention, with the piston in a first position;

FIG. 2B—is a schematic view of A-A cut of the piston and cylinder combination illustrated in FIG. 2A, with the piston in a first position;

FIG. 3A—is a schematic, cross-sectional view of the piston and cylinder combination illustrated in FIG. 2A, with the piston in a second position;

FIG. 3B—is a schematic view of A-A cut of the piston and cylinder combination illustrated in FIG. 3A, with the piston in a second position;

DETAILED DESCRIPTION OF THE DRAWINGS

Figure 1:
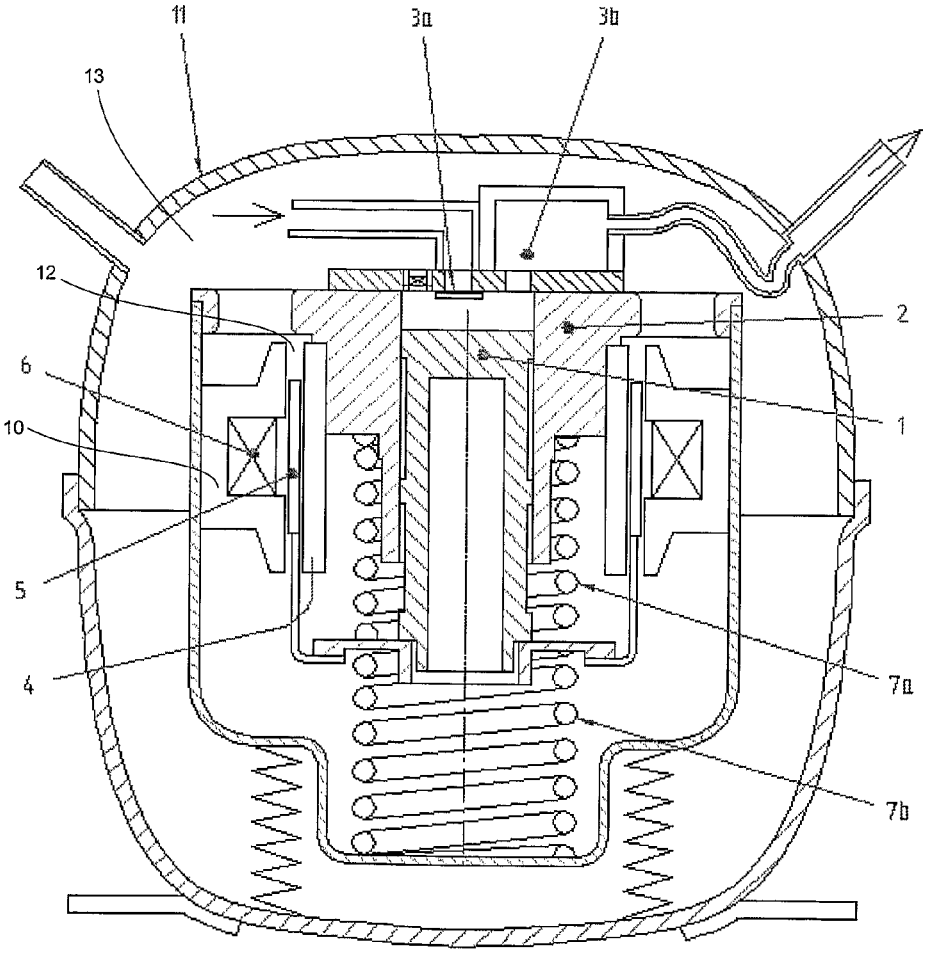
FIG. 1—is a cross-sectional view of a common linear motor compressor.

FIG. 1 illustrates a compressor with a linear motor to which the piston and cylinder combination driven by linear motor with cylinder position recognition system according to the present invention can be applied.

The piston and cylinder combination according to the invention, and as illustrated in a preferred embodiment in FIG. 1, comprises a cylinder 2, which comprises a valve board at its upper end, also named as valve head. This valve board comprises an air suction valve 3*a* that allows low pressure air into the cylinder 2, and an air discharge valve 3*b* that discharges high pressure air out of the cylinder, if the piston and cylinder combination is applied to an air compressor.

In other applications of the piston and cylinder combination according to the present invention, the suction and discharge valves 3*a* and 3*b*, which communicate with the inside of the cylinder 2, may operate with other types of fluids. For example, if the piston and cylinder combination is applied to a pump, valves 3*a* and 3*b* may allow in and discharge another kind of fluid, such as water.

The piston and cylinder combination also comprises a piston 1 that moves inside the cylinder 2, jointly constituting a resonating combination. Inside the cylinder 2, the piston carries on an alternate linear motion, exerting an action of compressing the gas allowed inside the cylinder by the suction valve 3*a*, until the point where this gas can be discharged to the high pressure side, through the discharge valve 3*b*.

The piston is coupled to at least a magnet 5, such that the displacement of the piston causes the corresponding displacement of the magnet and vice-versa. The magnet 5 is preferably placed around the outer surface of the piston, as can be seen in FIG. 1. In alternative embodiments of the invention, the magnet may be connected to the piston in different ways, for example, being fixed to a stem which is connected to the piston.

The piston and cylinder combination also has a support structure 4 which may work as a support for the piston 1 and/or as a guide for the displacement of the piston and/or the magnet 5. Along at least part of the support structure 4, an air gap 12 is formed where the magnet moves.

In a preferred embodiment of the invention shown in FIG. 1, two helicoidal springs 7*a* and 7*b* are mounted against the piston, on either side thereof, and said springs are preferably always compressed. The piston, jointly with the mobile parts of the actuator and the helicoidal springs, form the resonating combination of the compressor.

The actuator of the piston and cylinder combination is comprised of at least a motor winding 6, electrically powered in order to produce a magnetic field. The motor winding must be disposed in such manner that the magnetic field generated thereby acts on the displacement path of the magnet 5 of the piston 1. In a preferred embodiment of the invention illustrated in FIGS. 2, 2A, 2B, 3A and 3, the support structure 4 of the piston and cylinder combination is comprised of two E-shaped metallic parts, and a motor winding 6 is coupled on the central leg of each of these parts. The space formed between the two metallic parts coupled to the motor windings constitutes the air gap 12 which makes up the displacement path of the magnet 5.

Therefore, when the motor winding is electrically powered, it generates a magnetic flow at least along part of the air gap 12, and which can be variable and controlled, in accordance with the power voltage applied to the motor winding. Consequently, the variation of the magnetic field generated by the motor winding as a result of the voltage applied thereto induces the magnet 5 to moves reciprocatingly along the air gap 12, making the piston move away from and approach the valve board 3*a* and 3*b* of the cylinder, thus compressing the gas allowed inside the cylinder 2. The amplitude of piston operation corresponds to the total displacement amplitude of the piston 1 inside the cylinder 2.

The piston operation amplitude is regulated by the balance of the power generated by the actuator and the power consumed by the mechanism in the gas compression and other losses. To obtain maximum pumping capacity of the piston and cylinder combination, it is necessary to operate at an amplitude wherein the piston 1 moves as close as possible to the valve board 3*a*, 3*b*, but without collision. To ensure the feasibility thereof, the piston operation amplitude must be accurately known. The larger the estimated error of this displacement amplitude, the larger the safety distance between the piston and the valve board must be in order to avoid collision. Such collision is undesirable, as it causes a loud noise and may damage the equipment.

For this reason the piston and cylinder combination of the present invention comprises a linear motor drive system that recognizes the position of the piston 1 so as to enable the combination to operate with as much operating amplitude as possible, optimizing the pumping capacity of the piston 1 and the cylinder 2.

A preferred embodiment of the mechanism of the piston performance and cylinder position recognition in the piston and cylinder combination is illustrated in greater detail in FIGS. 2A, 2B, 3A and 3B.

An inductive sensor 8 is disposed at a point of the displacement path of the magnet 5 connected to the piston 1. According to the principles of electromagnetism, inductive devices, such as inductors or coils, transform a variation of a magnetic field into voltage, seen at the coil terminals. That way, since the inductive sensor 8 is disposed on the displacement path of the magnet, it is subject to magnetic field variations produced by the magnet 5 resulting from its displacement inside the air gap 12, or at other points of its displacement path. Therefore, the inductive sensor 8 is capable of identifying the positioning of the piston by monitoring the magnetic field produced by the magnet 5, and emits a voltage signal in response to the magnetic field variation observed.

However, according to the present invention, the main purpose of the inductive sensor is to identify when the piston has reached a maximum point of its operating amplitude, without colliding with the cylinder, this maximum point being considered the control position of the piston, or the upper dead center. Therefore, the sensor must be configured such that a displacement velocity of the magnet does not interfere with the determination of the control position.

In a preferred embodiment of the invention, the inductive sensor 8 is preferably embodied in the form of a simple coil, referred to herein as sensor coil. Additionally, to obtain a greater independence of velocity in determining the control position, a sensor coil is preferably constructed with narrow dimensions in the displacement direction of the magnet, and being elongated transversely to the displacement direction of the magnet. The elongated shape allows a greater output voltage of the sensor coil to be obtained without interfering in the resolution of the position of the sensor 8. Accordingly, there is a greater variation of the signal generated by the sensor on account of a significantly reduced displacement of the piston inside the cylinder, which increases the resolution of the sensor and decreases the system's susceptibility to errors due to noise disturbance. This configuration of the sensor 8 also has low impedance which provides a signal free of electrical noise, further contributing to the good precision of the sensor.

In an alternative embodiment of the invention, the sensor 8 may be configured like a coil having a wider format. This enables the sensor to measure a greater distance of the displacement of the piston, and thus can detect in advance that the piston 1 is approaching. This wider format enables the sensor to measure two different points of the piston inside the cylinder. However, the increase in width of the sensor causes a loss in resolution, because the signal generated is smoother, and varies less on account of the displacement of the piston inside the cylinder, making position measuring less accurate.

To precisely detect the control position of the piston, the sensor 8 must preferably be positioned inside the displacement path of the magnet, exactly in the position achieved by the lower edge of or at least one of the magnets 5, when the piston reaches the control position. Thus, when the edge of the magnet 5 passes over the sensor, the sensor emits a signal indicating that the piston has attained its control position, or upper dead center.

Figure 2:
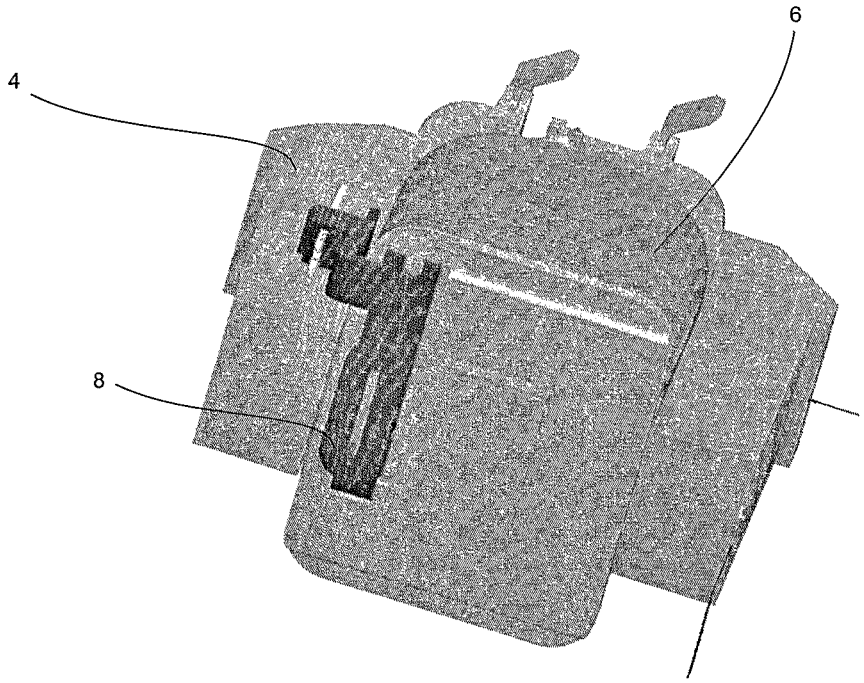
FIG. 2—is a perspective view of a coil associable to a piston and cylinder combination of the present invention, and to which the inductive sensor is coupled.

As can be seen in FIG. 2, in a preferred embodiment of the invention, the sensor 8 is coupled to the motor winding 6, being fixed to the motor winding 6 by means of a leg, and part of the sensor coil 8 faces towards the air gap wherein the magnet 5 moves. In this case, the piston and cylinder combination according to the invention was previously arranged so that this position in which the sensor is disposed coincides exactly with the position of the magnet, when the piston 1 is in the upper dead center (control position).

FIGS. 2*a*, 2*b*, 3*a* and 3*b* illustrate a sample embodiment of the piston and cylinder combination at two different moments of the compression cycle, in order to demonstrate how the cylinder position recognition system works. In these figures, the sensor is positioned in the same position illustrated in FIG. 2.

FIGS. 2*a* and 2*b* show the situation in which the cylinder is distant from the valve board, and the magnets 5 move along the air gap, and one of the magnets 5 moves across the front of the inductive sensor 8. FIG. 2*b* shows the view resulting from the A-A cut of FIG. 2*a*. FIGS. 3*a* and 3*b* illustrate a second moment of the compression cycle, in which the piston has attained its control position, that is, at its closest approach to the cylinder head and to the valve board 3*a* and 3*b*. At this point, the lower edge of one of the magnets 5 coincides with the position of the upper end of the sensor 8, as can be seen in detail in FIG. 3*b*. As a consequence, there is a variation of the magnetic field generated by the magnet 5 on the inductive sensor 8, which produces a greater variation of voltage between the terminals of the sensor, generating an electric signal indicating that piston 1 has attained control position.

In the example of FIGS. 2 and 3, the magnets 5 always remain inside the air gap 12 formed between the support structures 4 coupled to the motor windings 6. In this case, the air gap 12 coincides with the displacement path of the magnet 5.

Figure 4A:
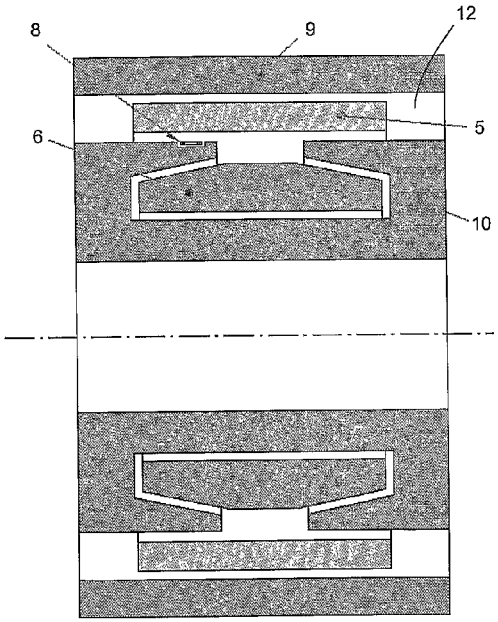
FIG. 4A—is a schematic, cross-sectional view of the piston and cylinder mechanism of the compressor of the present invention in a first position.
Figure 4B:
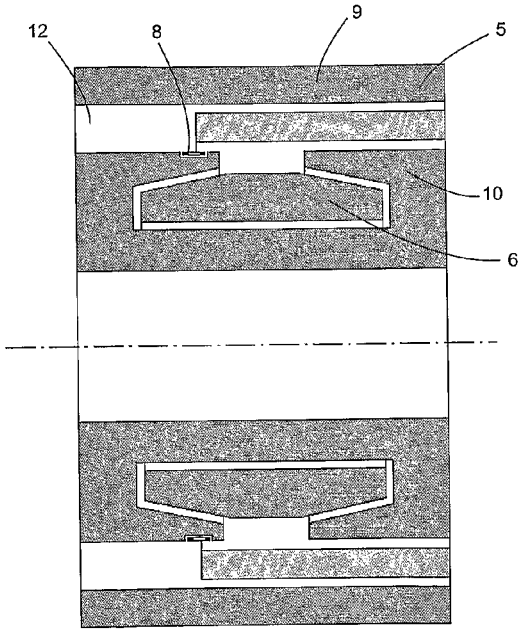
FIG. 4B—is a schematic, cross-sectional view of the piston and cylinder mechanism of the compressor of the present invention in a first position.

FIGS. 4*a* and 4*b* show a second embodiment of the drive system of the piston and cylinder combination of the present invention. These two figures illustrate a lengthwise cut view of the drive system of the cylinder-shaped piston. The drive system has a cylindrical stator 10, inside of which a cavity is formed, wherein a motor winding 6 is coupled which generates the electric field that induces the displacement of the magnet 5. A return iron 9, which carries out a function corresponding to the support structure 4, also cylindrical, surrounds the stator 10, such that between the inner surface of the return iron 9 and the outer surface of the stator 10 an air gap 12 is formed along which the magnet 5 of the piston reciprocatingly moves. The inductive sensor 8 is disposed inside the air gap 12, at the point coinciding with the lower end of the magnet 5, when the piston attains its nearest position to the cylinder head, without colliding. Preferably, the stator 10 can be provided with a small recess to house the sensor.

This sensor 8 is also preferably comprised of a sensor coil having a narrow configuration in the displacement direction of the magnet 5, and an elongated format transversally to the displacement direction of the magnet, but the sensor coil needs to be curved so that to follow the curvature of its accommodation site.

FIG. 4*a* illustrates a moment in which the piston 1 is distant from the cylinder head 2, and the magnet 5 moves across the front of the inductive sensor 8. FIG. 4*b* shows the instant in which the piston 1 has reached its control position inside the operation amplitude of the piston and cylinder combination and, consequently, the lower edge of the magnet 5 is located at the same height as the upper edge of the inductive sensor 8, within its displacement path. At this point, there will be a greater magnetic field variation on the sensor 8, thus producing a voltage difference between the terminals of the sensor, and generating a corresponding electric voltage signal, indicating that the piston 1 has attained control position.

The linear compressor having the piston and cylinder combination described herein is equally able of detecting the position of the piston inside the cylinder, according to the same principles also described herein, thus enhancing the performance of the compressor in terms of energy consumption and pumping capacity. Returning to FIG. 1, the piston 1 of the piston and cylinder combination according to the invention is connected to the magnet 5, which moves in a displacement path that comprises an air gap 12 formed between the support part 4, and the motor winding 6 coupled to the stator 10. This motion of the magnet induces the alternate motion of the piston 1 inside the cylinder 2, such that it compresses the gas admitted inside the cylinder by the suction valve 3*a*, and discharges the high pressure gas through discharge valve 3*b*.

The linear compressor is mounted inside a chassis 11. The space formed between the compressor and the chassis constitutes a low pressure chamber 13, where the low pressure gas is contained. The suction valve 3*a* of the cylinder communicates with the low pressure chamber 13 and admits air inside the cylinder 2. The discharge valve 3*b* of the cylinder discharges the high pressure air, which was compressed inside the cylinder by the motion of the compression piston, to a hermetically-isolated high-pressure region of the low pressure chamber.

An inductive sensor 8 (not illustrated in FIG. 1), like the sensor coil elongated transversally to the displacement direction of the magnet, and narrow in the displacement direction of the magnet, is disposed on the displacement path of the magnet 5, and may be inside or outside the air gap 12, at a point corresponding to the position attained by the magnet 5 when the piston is in control position, at its closest approach to the cylinder head without colliding. The variation of the magnetic field emitted by the magnet on the inductive sensor, caused by the fact that the magnet 5 moves away from the sensor 8, produces a voltage difference between the terminals of the inductive sensor, generating a voltage signal indicating that the piston has reached the control position.

Thus, the displacement amplitude of the piston 2 inside the cylinder can be controlled, by virtue of the fact that the recognition system detects when the cylinder has attained control position. Consequently, the compressor according to the invention is capable of operating so as to optimize its compression capacity, since it has a significantly reduced anti-collision safety distance, and consequently also optimizing the power consumption of the equipment.

Figure 5:
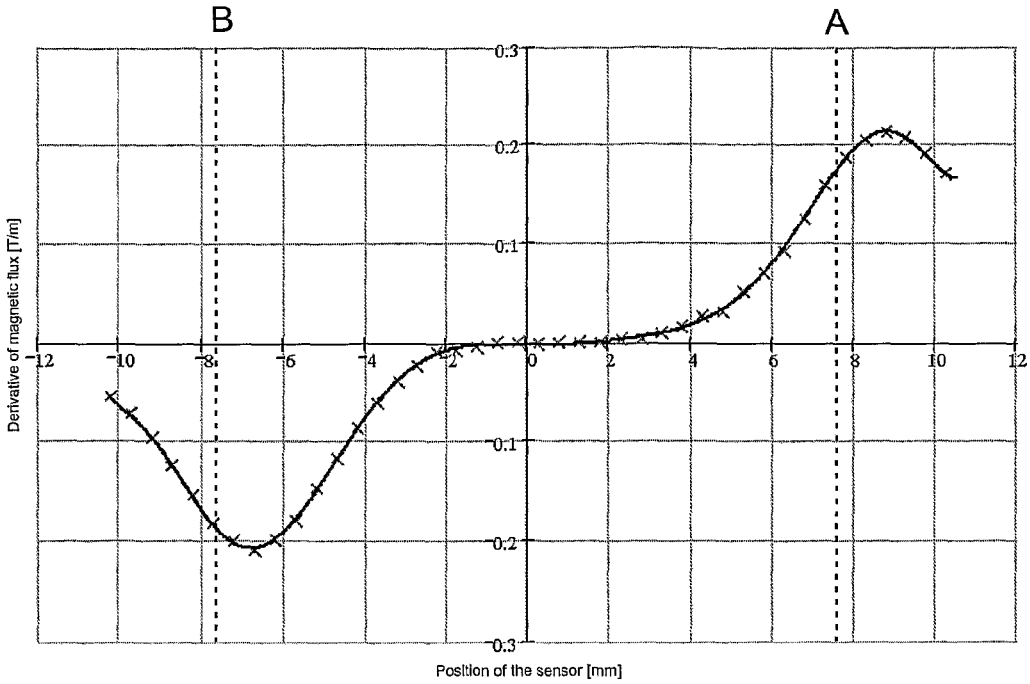
FIG. 5—is a graph representing the variation of the magnetic flow of the signal generated by the sensor based on the variation of the position of the magnet inside its displacement path.

The graph in FIG. 5 shows the variation of the magnetic flow of the signal generated by the sensor 8 as a result of the variation of the position of the magnet 5 shown in millimeters. The vertical line designated as A (left) corresponds to the lowest maximum point of displacement of the piston (or lower dead center), and the vertical line designated as B (right) corresponds to the upper dead center or control position of the piston. Preferably, the magnet should not move beyond these vertical lines A and B, so as to ensure a safety distance in relation to the valve board, or to any other element with which it may collide at the lower end of the path.

The sensor should indicate proportionally the approach of the piston. Accordingly, in a preferred embodiment of the invention and with the purpose of obtaining the most accurate result possible from the sensor, the vertical lines A and B of upper dead center and lower dead center should be positioned relatively to the signal from the sensor, in the portions of this signal in which an ascending ramp (upper dead center) and a descending ramp (lower dead center) are formed, which are the regions where the signal of the sensor is the most linear possible. Further to the right, there is an inflection point, and from there onwards the variation of the signal begins to diminish, which lowers the resolution of the sensor.

If a sensor with a wider coil is used, the variation curve of the magnetic flow of the signal becomes flatter and smoother. So, instead of managing to measure the variation of position of the sensor between approximately 6 to 7.5 mm, it would be possible to measure between approximately 4 and 8 mm, but the resolution of the sensor would be lower, because the variation of the signal would also be lower due to a same variation of position. Therefore, the sensor would be more subject to errors due to the interference of noise.

Figure 6:
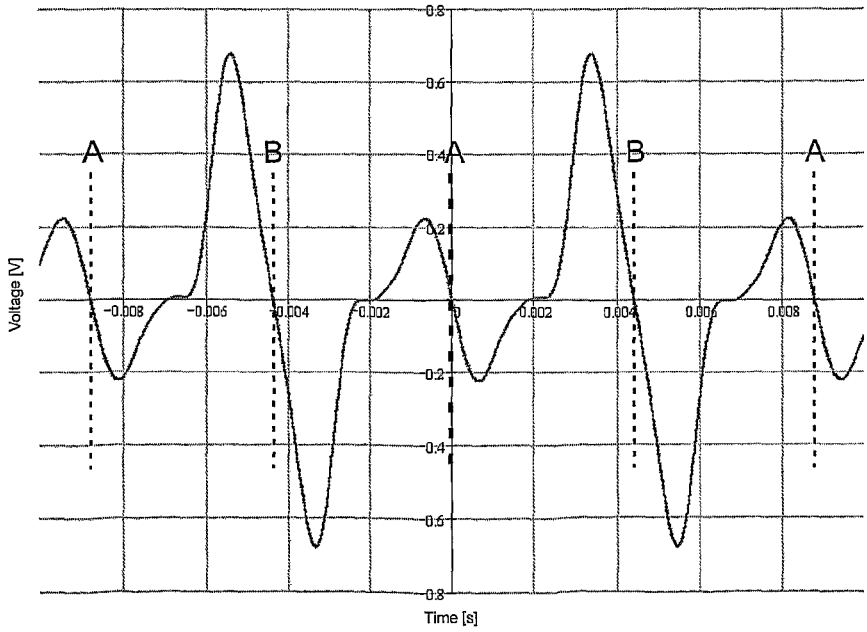
FIG. 6—is a graph representing the voltage signal generated by the sensor over time, during some cycles of displacement of the piston.

The graph in FIG. 6 represents the voltage signal generated by the sensor over time, during some cycles of displacement of the piston. Again, the vertical lines designated as A correspond to the positions of upper dead center and the vertical lines designated as B correspond to the positions of lower dead center of the piston. The voltage signal emitted by the sensor is generated by the following equation:

$$V\text{sensor}=f(x)\times v_\text{magnet}$$

wherein:

Vsensor is the voltage of the signal generated by the sensor;

f(x) is the signal shown in the graph of FIG. 5, that is, the variation of the magnetic flow of the signal generated by the sensor; and v_magnet is the displacement velocity of the magnet.

Permanent magnet motors generate a signal relating to their counter-electromotive force which is proportional to the displacement velocity of the magnet and of the piston (v_magnet signal). Since the motor is resounding, there is a maximum point at the center of the displacement path, where the velocity is maximum, and two zero crossings at the two ends of the path, which are the upper and lower dead centers. The velocity of the magnet is practically a sinusoid. Since, at the upper and lower dead centers, the velocity of the magnet is equal to zero, then by multiplying the signal f(x) by the v_magnet signal, the result, which is Vsensor, is equal to zero at these points. This is why, in the graph of FIG. 6, in all the vertical dotted lines A and B, the voltage signal of the sensor is zero.

So, based on this signal, it is possible to recognize when the piston is approaching either end of the path. In the case of the present invention, this crossing can be used to determine that the piston has attained its maximum point and that it may then collide with the valve board.

Therefore, the current sensor generates two signals, one for upper dead center and the other for the lower dead center, but the position is optimized to have the best signal at the upper dead center, because in this embodiment, the sensor is located in the position that the edge of the magnet reaches, when the piston is in upper dead center position. An analysis could then also be made of the lower dead center, but less accurately due to the current position of the sensor.

According to the present invention, the cylinder position recognition system can also be used to detect the lower dead center of the piston inside the cylinder, which may be important in the event of risk of collision of the piston with any other component, when it is returning. This embodiment of the invention can be achieved by using the same inductive sensor 8, but allocated to another position, to detect when the edge of the magnet 5 is in the position corresponding to lower dead center. In other words, in this case, the sensor 8 must be disposed in the place that the upper edge of or at least one of the magnets 5 attains, when the piston reaches the lower dead center position. So, when the edge of the magnet 5 passes over the sensor, the sensor emits a signal indicating that the piston has reached its position of lower dead center.

Therefore, according to the present invention, just one inductive sensor 8 can be used to measure simultaneously the upper dead center and the lower dead center, or two sensors 8 can be used, each one suitably positioned to carry out one of these functions.

As can be clearly understood in the preceding description, the present invention is capable of providing a means of measuring the displacement amplitude of the piston inside the cylinder with high accuracy. Furthermore, the signal indicating that the piston has attained its control position, or lower dead center, is free of electrical noise disturbance, which also contributes to the accuracy of the system.

Additionally, the equipment to detect the amplitude of the displacement of the piston inside the cylinder is very simple, as it essentially consists of a sensor placed in a strategic position to identify the position of the cylinder, and the signal generated by this sensor, or a specific variation this signal undergoes, is sufficient to indicate that the piston has reached control position. Thus, the equipment dispenses with the use of electronic circuits to deal with the signal of the position sensor.

Having described one example of a preferred embodiment, it must be understood that the scope of the present invention encompasses other potential variations, and is only limited by the content of the claims appended hereto, other possible equivalents being included therein.

The invention claimed is:

1. A piston and cylinder combination driven by a linear motor with cylinder position recognition system for providing a maximum operation capacity of the piston and cylinder combination, avoiding a collision of the piston with a cylinder head, said piston and cylinder combination comprising:

a support structure forming an air gap;

a motor winding generating a variable magnetic flow at least along part of the air gap;

a cylinder having a head at one of its ends;

a piston connected to a magnet, the magnet being driven by the magnetic flow of the motor winding to move along a displacement path including at least partially the air gap; the displacement of the magnet making the piston reciprocatingly move inside the cylinder;

an inductive sensor comprising a sensor coil coupled directly to the motor winding adjacent to the displacement path of the magnet, the sensor coil comprising an oblong shape including an elongated dimension and a narrow dimension, wherein said elongated dimension is elongated relative to said narrow dimension, and wherein the elongated dimension extends transversely relative to the displacement path of the magnet and the narrow dimension extends axially along the displacement path of the magnet such that the sensor coil faces toward the air gap through which the magnet moves, and the magnet moves on the displacement path across the narrow dimension of the sensor coil, and such that when the piston reaches a pre-selected position in the displacement path, an edge of the magnet coincides with the position of the sensor, thereby inducing a variation in the magnetic field detected by the inductive sensor resulting from the corresponding position of the magnet, and the inductive sensor generates a voltage signal arising from this magnetic field variation.

2. The piston and cylinder combination according to claim 1, wherein the pre-selected position which the piston reaches is a position of the displacement path at its closest approach to the cylinder head.

3. The piston and cylinder combination according to claim 1, wherein the pre-selected position that the piston reaches is a position of the displacement path farthest from the cylinder head.

4. The piston and cylinder combination according to claim 1, wherein when the piston reaches a position of closest approach to the cylinder head, the position of the lower edge of the magnet coincides with the position of the upper end of the sensor, and the variation of the magnetic field applied by the magnet on the inductive sensor produces a voltage difference between the terminals of the inductive sensor.

5. The piston and cylinder combination according to claim 1, wherein the inductive sensor is disposed at a point of the displacement path of the magnet coinciding with the position of the magnet when the piston reaches a position farthest from the head.

6. The piston and cylinder combination according to claim 5, wherein when the piston reaches a position farthest from the cylinder head, the position of the upper edge of the magnet coincides with the position of the lower end of the sensor, and the variation of the magnetic field applied by the magnet on the inductive sensor produces a voltage difference between the terminals of the inductive sensor.

7. The piston and cylinder combination according to claim 1, wherein the inductive sensor is disposed inside the air gap.

8. The piston and cylinder combination according to claim 1, wherein the inductive sensor is disposed outside the air gap.

9. A linear motor compressor having a piston and cylinder combination and a cylinder position recognition system for providing a maximum operation capacity of the piston and cylinder combination, avoiding a collision of the piston with a cylinder head and a valve board, the linear motor compressor comprising:

a support structure forming an air gap;

a motor winding generating a variable magnetic flow at least along part of the air gap;

a cylinder having a head and a valve board at its upper end, which admits low pressure air into the cylinder, from a low pressure air chamber, and discharges high pressure air out of the cylinder;

a piston connected to a magnet, the magnet being driven by the magnetic flow of the motor winding to move inside along a displacement path including at least partially the air gap; the displacement of the magnet making the piston reciprocatingly move inside the cylinder;

an inductive sensor comprising a sensor coil coupled directly to the motor winding adjacent to the displacement path of the magnet, the sensor coil comprising an oblong shape including an elongated dimension and a narrow dimension, wherein the elongated dimension is longer than the narrow dimension, and wherein the elongated dimension extends transversely relative to the displacement path of the magnet and the narrow dimension extends axially along the displacement path of the magnet such that the sensor coil faces toward the air gap, in which the magnet moves, and the magnet moves on the displacement path across the narrow dimension of the sensor coil, and such that when the piston reaches at least a pre-selected position, an edge of the magnet coincides with the position of the sensor, the inductive sensor detects a magnetic field variation resulting from the corresponding position of the magnet, and generates a voltage signal arising from this magnetic field variation.

10. The linear motor compressor according to claim 9, wherein the pre-selected position which the piston attains is a position of the displacement path at its closest approach to the valve board.

11. The linear motor compressor according to claim 9, wherein the pre-selected position which the piston reaches is a position of the displacement path farthest from the valve board.

12. The linear motor compressor according to claim 9, wherein the inductive sensor is disposed at a point of the displacement path of the magnet coinciding with the position of the magnet when the piston reaches a position of closest approach to the valve board.

13. The linear motor compressor according to claim 9, wherein when the piston reaches a position of closest approach to the valve board, the position of the lower edge of the magnet coincides with the position of the upper end of the inductive sensor, and the variation of the magnetic field applied by the magnet on the inductive sensor produces a voltage difference between the terminals of the inductive sensor.

14. The linear motor compressor according to claim 9, wherein the inductive sensor is disposed at a point of the displacement path of the magnet coinciding with the position of the magnet when the piston reaches a position farthest from the valve board.

15. The linear motor compressor according to claim 14, wherein when the piston reaches a position farthest from the valve board, the position of the upper edge of the magnet coincides with the position of the lower end of the inductive sensor, and the variation of the magnetic field applied by the magnet on the inductive sensor produces a voltage difference between the terminals of the inductive sensor.

16. The linear motor compressor according to claim 15, wherein the inductive sensor is disposed inside the air gap.

17. The linear motor compressor according to claim 9, wherein the inductive sensor is disposed outside the air gap.

18. An inductive sensor applicable to a linear motor compressor comprising a support structure forming an air gap, a motor winding and a piston connected to a magnet, the magnet being driven by the magnetic flow of the motor winding to move on a displacement path including at least partially the air gap; the displacement of the magnet making the piston reciprocatingly move inside the cylinder;

the inductive sensor comprising a sensor coil coupled directly to the motor winding adjacent to the displacement path of the magnet, the sensor coil comprising an oblong shape including an elongated dimension and a narrow dimension, wherein the elongated dimension is longer than the narrow dimension, and wherein one the elongated dimension extends transversely relative to the displacement path of the magnet and the narrow dimension extends axially along the displacement path of the magnet such that the sensor coil faces toward the air gap where the magnet moves, and the magnet moves on the displacement path across the narrow dimension of the sensor coil.

* * * * *